US007668445B2

(12) United States Patent
Miller et al.

(10) Patent No.: US 7,668,445 B2
(45) Date of Patent: Feb. 23, 2010

(54) APPARATUS AND METHOD FOR DETECTING CONDITION OF A HEATING ELEMENT

(75) Inventors: William E. Miller, Centerburg, OH (US); Lawrence J. Brazis, Orrville, OH (US)

(73) Assignee: Emerson Electric Co., St. Louis, MO (US)

( * ) Notice: Subject to any disclaimer, the term of this patent is extended or adjusted under 35 U.S.C. 154(b) by 432 days.

(21) Appl. No.: 11/495,067

(22) Filed: Jul. 28, 2006

(65) Prior Publication Data

US 2008/0080844 A1 Apr. 3, 2008

(51) Int. Cl.
*H05B 3/80* (2006.01)

(52) U.S. Cl. ..... 392/498

(58) Field of Classification Search ..... 392/498, 392/497, 499, 500, 501, 502, 503; 119/73; 219/437, 523; 337/298, 417
See application file for complete search history.

(56) References Cited

U.S. PATENT DOCUMENTS 4,634,834 A * 1/1987 Lupoli et al. ..... 219/208
4,929,930 A * 5/1990 Rezabek ..... 340/622
5,149,399 A * 9/1992 Kishi et al. ..... 159/22
5,304,286 A * 4/1994 Palmer ..... 202/167
5,504,306 A * 4/1996 Russell et al. ..... 219/497

* cited by examiner

*Primary Examiner*—Daniel L Robinson
(74) *Attorney, Agent, or Firm*—Harness, Dickey & Pierce, P.L.C.

(57) ABSTRACT

A control for an electric water heater detects a condition of a heating element when the heating element is not being energized. A switching module is operable to interrupt power to the heating element, which de-energizes the heating element. A detector module detects the condition of the heating element when the heating element is de-energized. The detector module senses current flowing through the heating element and generates a detection signal that is indicative of the current.

16 Claims, 7 Drawing Sheets

APPARATUS AND METHOD FOR DETECTING CONDITION OF A HEATING ELEMENT

FIELD OF THE INVENTION

The present invention relates to electric water heater control, and more particularly to an electric water heater control employing a method for detecting high temperature conditions in electric water heaters.

BACKGROUND OF THE INVENTION

This application relates to the art of controls and methods for operating electric water heaters. The invention is particularly applicable to a control and method that uses a control module running software and will be described with specific reference thereto. However, it will be appreciated that the invention has broader aspects and can be carried out with other types of controls.

An electric water heater energizes one or more heating elements located within the water heater tank to heat water. Electrical power to the heating elements is managed through the operation of a control module, which controls the opening and/or closing of electrical relays connected in series between a power source and the heating elements. The thermal energy generated by the heating elements dissipates in the water, thereby heating the water according to a desired or preset water temperature. The control module is operable to interrupt power to the heating elements by opening one or more of the electrical relays.

Certain circumstances may cause the heating elements to malfunction or burn out, causing an open circuit. When this occurs, the control module is unable to use the heating element to heat the water. Operation of the electric water heater with an open heating element may result in further damage to one or more additional components of the electric water heater. Therefore, it is desirable to detect an open heating element prior to providing power to the heating element.

SUMMARY OF THE INVENTION

A control for an electric water heater detects a condition of a heating element. A switching module has an open state and a closed state and is connected between a first voltage potential and a second voltage potential. When the switching module is in the open state, the heating element is not energized. When the switching module is in the closed state, the heating element is energized. A detector module is connected in parallel to the switching module. The detector module senses current flowing through the heating element when the switching module is in the open state. The detector generates a detection signal that is indicative of the current.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Figure 1:
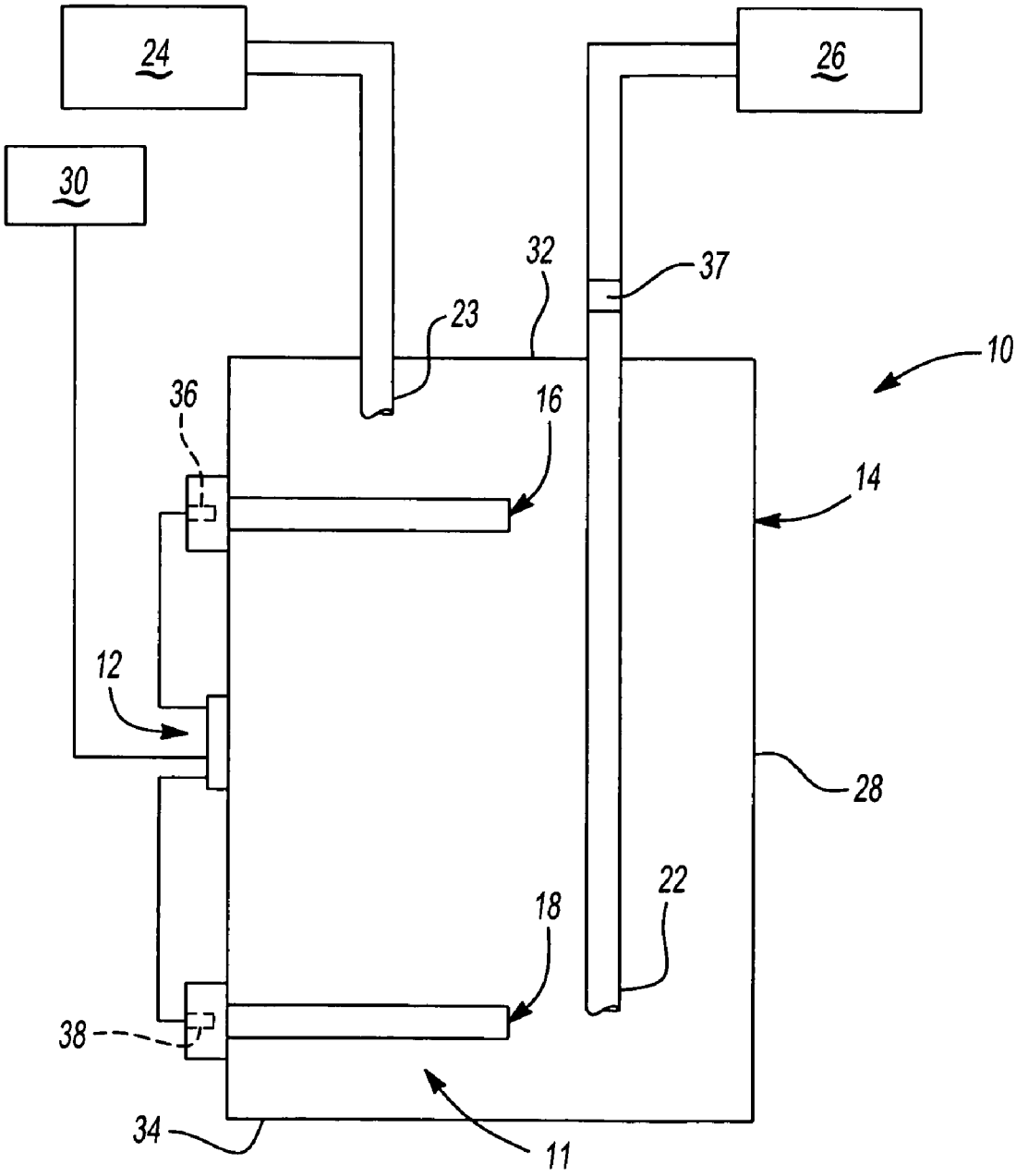
FIG. 1 is a schematic diagram of an electric water heater according to the prior art.

With reference to FIG. 1, the electric water heater 10 is shown and includes a tank 14, an upper heating element 16, and a lower heating element 18. The tank 14 defines an inner volume 11 and includes an inlet 22 and an outlet 23, both fluidly coupled to the inner volume 11. The inlet 22 is fluidly coupled to a water supply 24 while the outlet 23 is connected to building fixtures such as faucets and showers, schematically represented as 26 (FIG. 1). In this manner, the inlet 22 receives a constant supply of cold water under pressure from the building supply 24 such that the inner volume 11 of the tank 14 is always full of water. Water only exits the tank 14 via outlet 23 when water is consumed at one of the fixtures 26 throughout the building. Therefore, cold water only enters the tank 14 when hot water is consumed (i.e., exits the tank 14 via outlet 23).

The upper heating element 16 extends through a side wall 28 of the tank 14 and generally into the inner volume 11. The upper heating element 16 is electrically connected to a building power supply 30 and is disposed near to an upper wall 32 of the tank 14. The upper heating element 16 receives current from the power supply 30 via control module 12 such that the control module 12 regulates the upper heating element 16 between an ON state and an OFF state.

The lower heating element 18 extends through the side wall 28 of the tank 14 and generally into the inner volume 11. The lower heating element 16 is electrically connected to the building power supply 30 and is disposed near to a lower wall 34 of the tank 14 such that the lower heating element 18 is generally closer to the lower wall 34 of the tank 14 than the upper heating element 16 is to the upper wall 32. The lower heating element 18 receives current from the power supply 30 via control module 12 such that the control module 12 regulates the lower heating element 18 between an ON state and an OFF state.

The electric water heater 10 also includes an upper temperature sensor 36 and a lower temperature sensor 38, each in communication with the control module 12. The upper and lower temperature sensors 36 and 38 are in communication with the control module 12 such that readings from the upper and lower temperature sensors 36 and 38 are transmitted to the control module 12 for processing.

The upper temperature sensor 36 is disposed adjacent to the upper heating element 16 to monitor a temperature of water within the tank 14 generally between the upper heating element 16 and the upper wall 32. The lower temperature sensor 38 is disposed adjacent to the lower heating element 18 to monitor a temperature of water within the tank 14 generally between the lower heating element 18 and the upper heating element 16. The temperature sensors 36 and 38 are preferably thermistors, such as an NTC thermistors, but could be any suitable temperature sensor that accurately reads the temperature of the water within the tank 14.

During operation, the control module 12 receives information from the sensors 36 and 38 for use in selectively actuating the upper heating element 16 and/or lower heating element 18 to the ON state. Furthermore, the sensor module 35 could also include a flow sensor 37 disposed at the inlet 22 or the outlet 23 of the tank 14 to monitor a flow of water entering or exiting the tank 14. The flow sensor 37 can be used to indicate exactly how much water has been consumed over a predetermined amount of time and can therefore be used in determining when the upper and lower heating elements 16, 18 should be toggled to the ON state to thereby heat water disposed within the tank 14.

Figure 2:
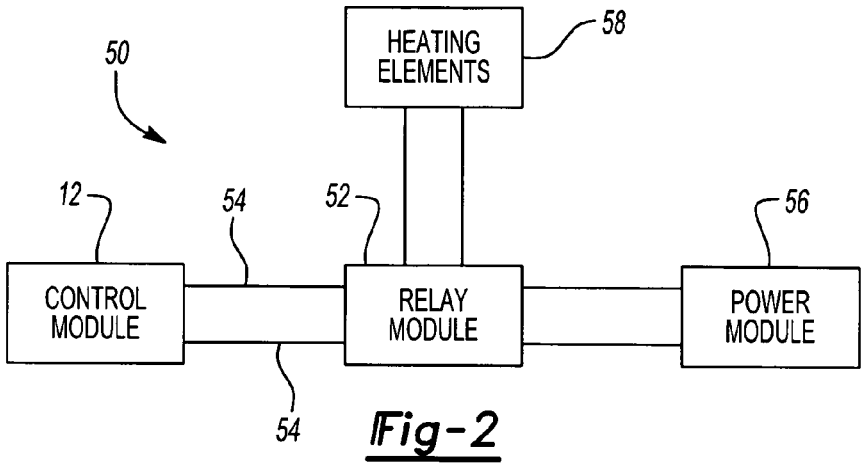
Fig-2 PRIOR ART
FIG. 2 is a functional block diagram of a water heater control according to the prior art.

An exemplary electric water heater control 50 is shown in FIG. 2. The water heater control 50 includes a control module 12 and a relay module 52. The control module 12 is an electronic circuit and/or memory, such as a processor, that execute one or more software or firmware programs. For example, the control module 12 may include one or more software modules. The control module 12 generates one or more relay control signals 54 to determine a status of the relay module 52. For example, if the water temperature exceeds a particular threshold, the control module 12 opens or closes one or more relays of the relay module 52. In this manner, the control module 12 interrupts power between a power module 56 and one or more heating elements, represented schematically at 58.

Figure 3:
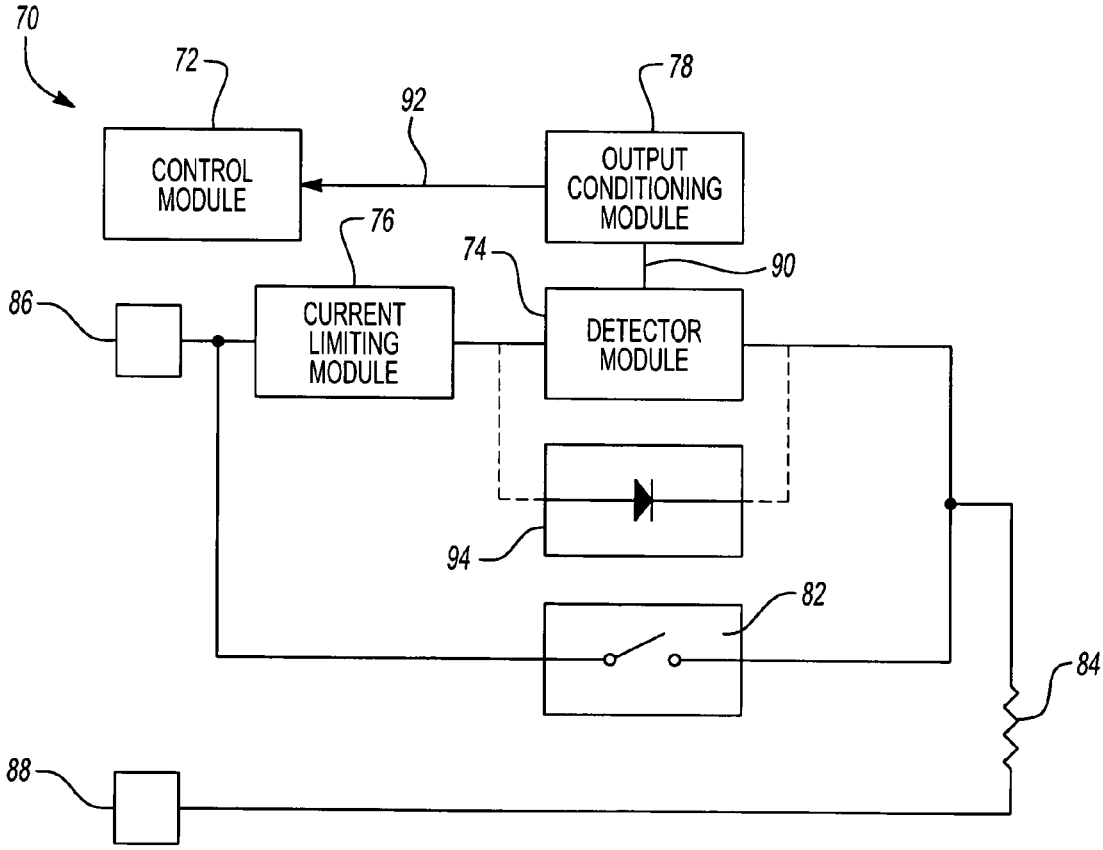
FIG. 3 is a functional block diagram of a water heater control that provides element out protection according to the invention.

Referring now to FIG. 3, the electric water heater control 70 of the invention provides element out detection of one or more heating elements. The electric water heater control 70 includes a control module 72 and a detector module 74. The electric water heater control 70 may also include a current limiting module 76 and an output conditioning module 78. The detector module 74 includes a device for detecting a current through the detector module 74. For example, the detector module 74 may include a relay, hall effect current sensor, current transformer, optoisolator, or any other suitable device.

When a relay 82 is closed and a heating element 84 is functioning properly, current flows between voltage sources 86 and 88, and through the heating element 84, thereby energizing the heating element 84. The voltage potential across the current limiting module 76 and the detector module 74 is minimal. When the relay 82 is open (i.e. before the heating element 84 is energized) and the heating element is functioning properly, current flows through the detector module 74 and the heating element 84. The detector module 74 detects the current and generates a detector output 90 that is indicative of the current. If the relay 82 is open and the heating element 84 is not functioning properly (e.g. the heating element 84 is out or open), current does not flow through the detector module 74 and the heating element 84. In other words, the detector output 90 is indicative of whether the heating element 84 is functioning properly.

The output conditioning module 78 receives the detector output 90 and outputs a signal 92 indicative of the detector output 90 to the control module 72. The output conditioning module 78 may include any device operable to interface between the detector output 90 and the control module 72. For example, the output conditioning module 78 may include a pull-up resistor, rectification circuit, integrator, pulse counter, amplifier, or any other suitable device.

The current limiting module 76 limits current through the detector module 74 and the heating element 84 when the relay 82 is open. For example, the voltage difference between the voltage sources 86 and 88 may be 240 VAC for energizing the heating element 84. Therefore, the current limiting module 76 may be used to protect the circuitry of the detector module 74 and limit current through the heating element 84. The current limiting module 76 may include a resistor, capacitor, or any other AC impedance device.

The electric water heater control module 50 may also include a diode 94. The diode 94 may function as a reverse bias relief device that protects reverse bias breakdown in polarized devices. For example, if one or more devices of the detector module 74 is polarized, the diode 94 may be included. If detector module 74 does not include a polarized device, the diode 94 may be omitted.

Figure 4:
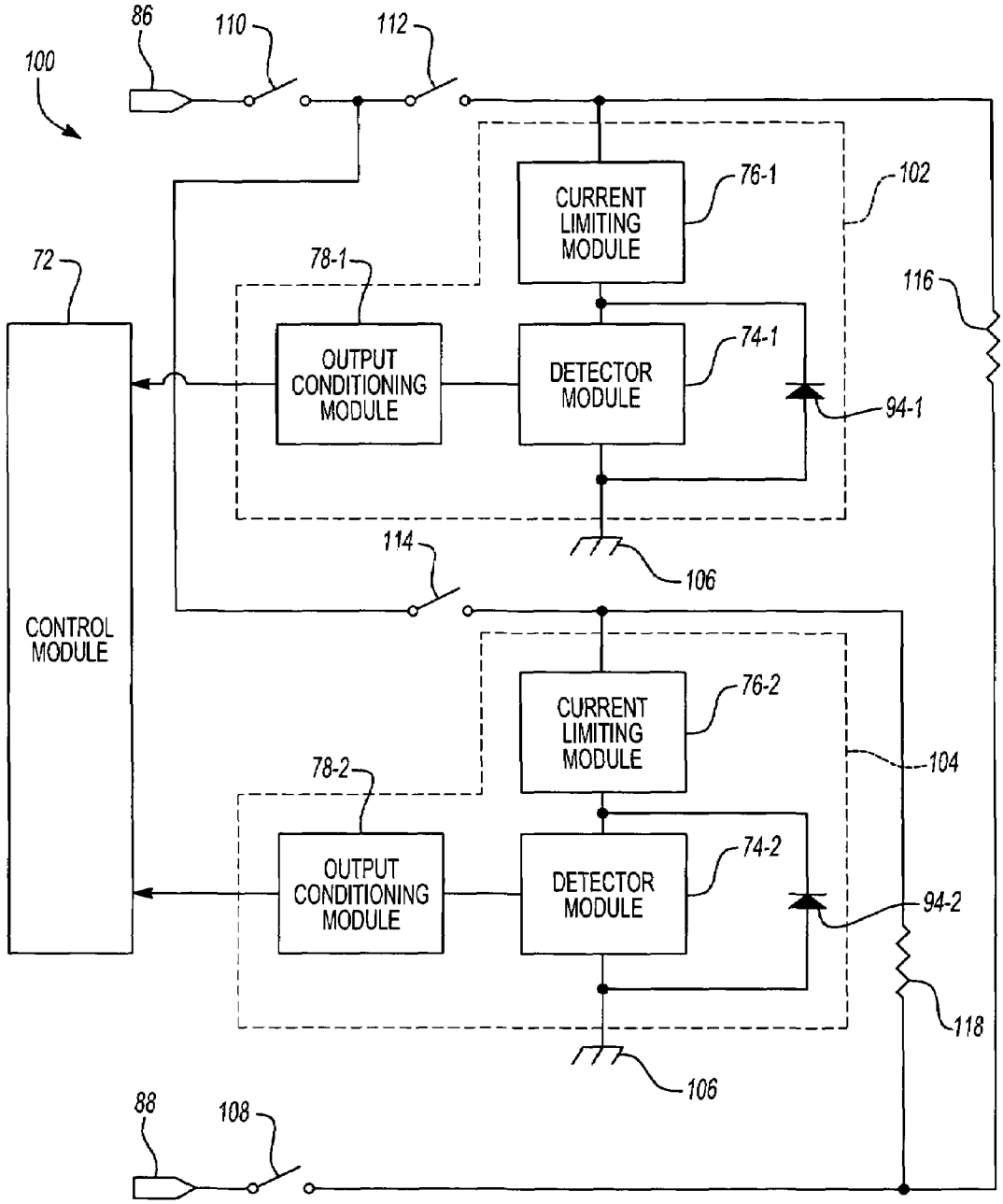
FIG. 4 is a functional block diagram of a water heater control including a detector module referenced to earth ground according to the invention.

Referring now to FIG. 4, an alternative implementation of an electric water heater control 100 includes first and second element out detection modules 102 and 104, respectively, that are referenced to an earth ground 106. The first element out detection module 102 includes a detector module 74-1, a current limiting module 76-1, an output conditioning module 78-1, and a diode 94-1. Similarly, the second element out detection module 104 includes a detector module 74-2, a current limiting module 76-2, an output conditioning module 78-2, and a diode 94-2. When relays 108 is closed, relays 110, 112, and 114 are open. Current flows between the second voltage source 88 and the earth ground 106, through the upper and lower heating elements 116 and 118.

In this manner, the current flowing between the second voltage source 88 and the earth ground 106 is significantly less than the current flowing between the first voltage source 86 and the second voltage source 88. Therefore, the current limiting modules 76-1 and 76-2 can be designed to accommodate less than the full 240 VAC potential between the first voltage source 86 and the second voltage source 88. In other words, the current limiting modules 76-1 and 76-2 provide an impedance for 120 VAC rather than an impedance for 240 VAC.

Figure 5:
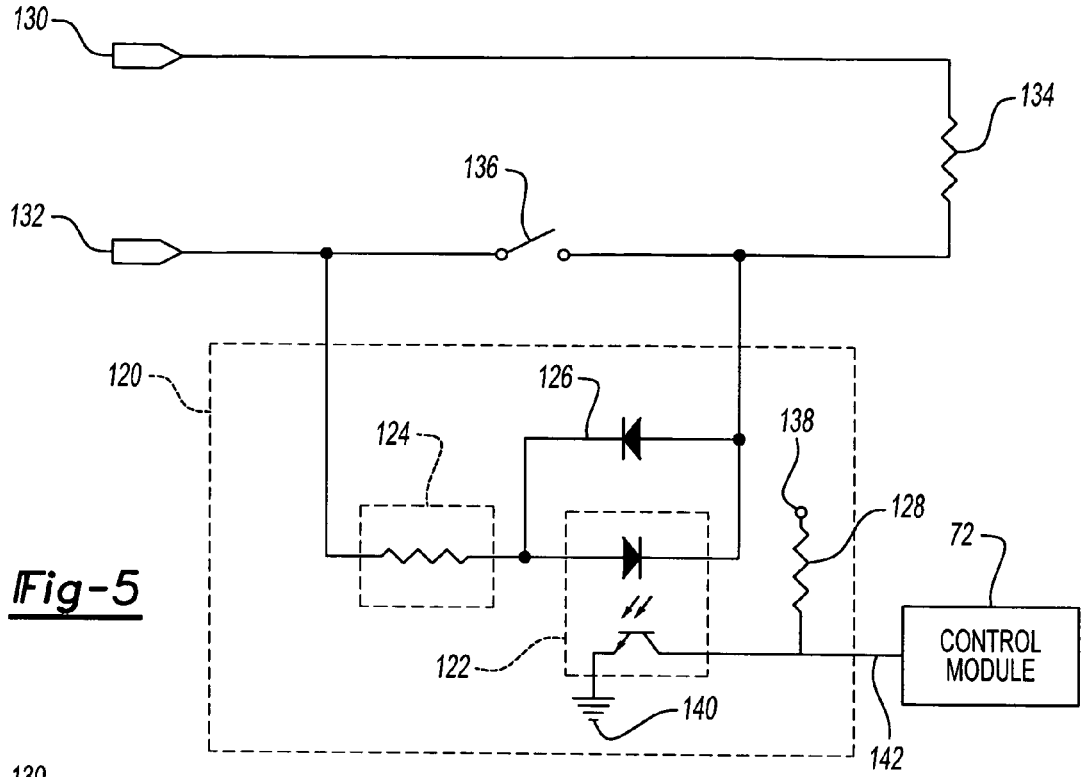
FIG. 5 is a schematic diagram of a water heater control including a current limiting resistor according to the invention.

Referring now to FIG. 5, a first implementation of an element out detection circuit 120 is shown according to the implementation described in FIG. 3. The element out detection circuit 120 includes an optoisolator 122, a current limiting resistor 124, and a reverse bias relief diode 126. A resistor 128 conditions an output 130 of the optoisolator 122 for the control module 72. First and second voltage sources 130 and 132 provide current to a heating element 134 when a relay 136 is closed as described above, and current through the element out detection circuit 120 is minimal. When the relay 136 is open and the heating element 134 is functioning properly, optoisolator 122 is ON, and current flows between a potential 138 and ground 140, through the resistor 128. In this manner, the control module 72 receives a detection signal 142 indicative of the current flowing through the element out detection circuit 120. In the present implementation, the first and second voltage sources 130 and 132 provide alternating current, and therefore the detection signal 142 will pulse accordingly.

Conversely, if the relay 136 is open and the heating element 134 is out, current does not flow through element out detection circuit 120, and the optoisolator 122 is OFF. Therefore, the detection signal 142 indicates that there is no current flowing through the element out detection circuit 120. In other words, the detection signal 142 will remain at one of a high or low logic level, and will not pulse. Although only one element out detection circuit 120 is shown, those skilled in the art can appreciate that any number of element out detection circuits 120 may be implemented for one or more heating elements as described above and in FIG. 3.

Figure 6:
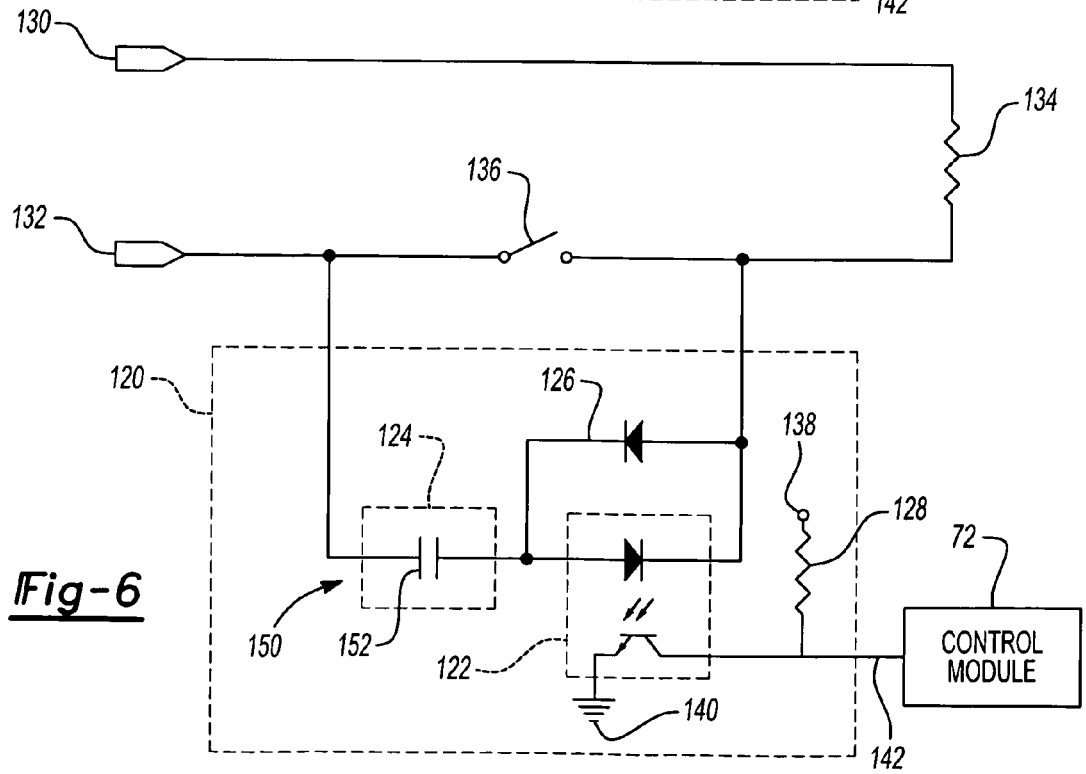
FIG. 6 is a schematic diagram of a water heater control including a current limiting capacitor according to the invention.

Referring now to FIG. 6, a second implementation of the element out detection circuit 150 replaces the current limiting resistor 124 with a current limiting capacitor 152. A phase shift of the current through the current limiting element (e.g. the current limiting resistor 124 or capacitor 152) relative to the voltage generates heat. The current limiting capacitor 152 reduces the power dissipation of the current limiting element.

Figure 7:
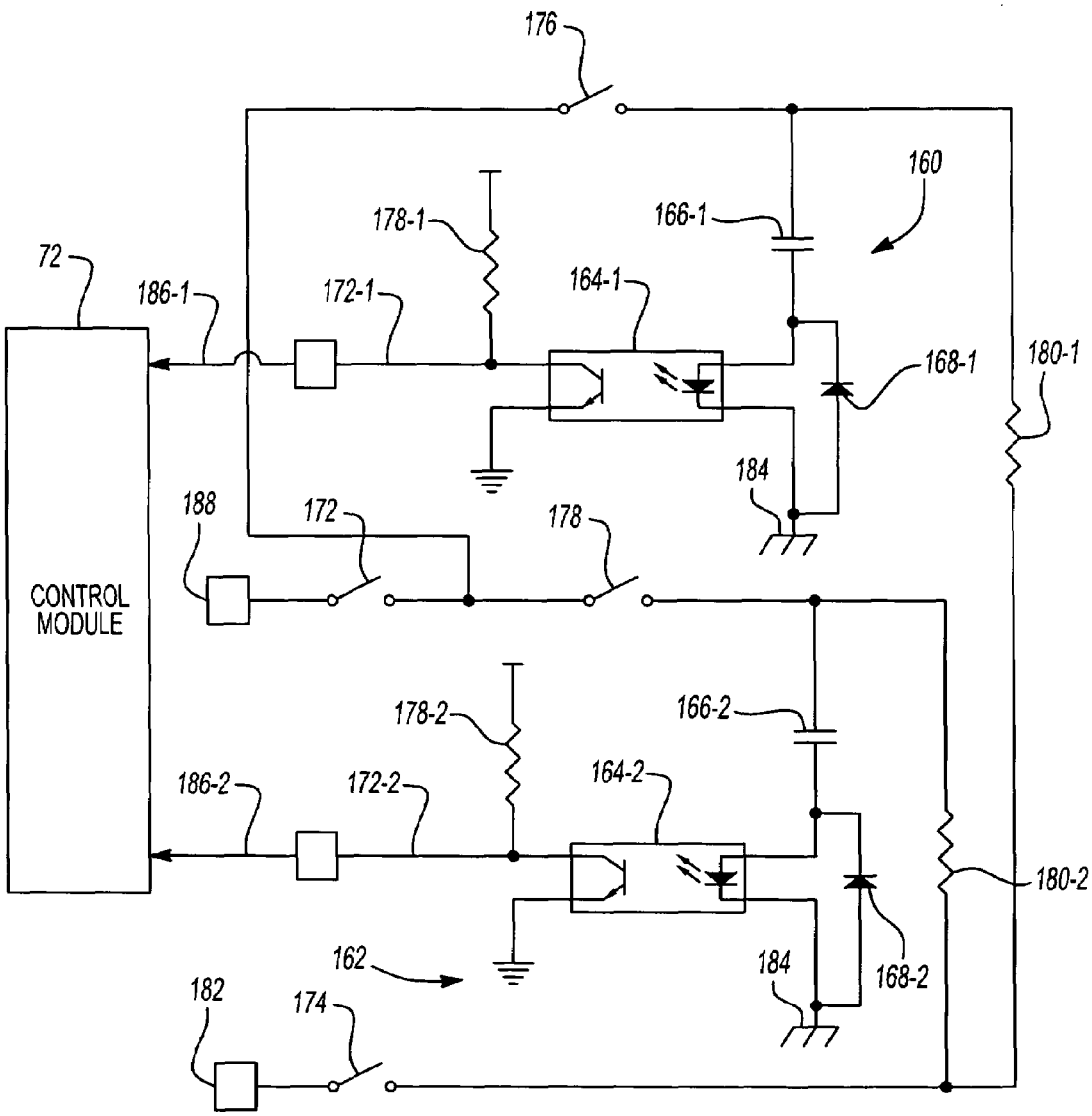
FIG. 7 is a schematic diagram of a water heart control including an element out detection circuit referenced to earth ground according to the invention.

Referring now to FIG. 7, a third implementation of the invention including first and second element out detection circuits 160 and 162 is shown according to the implementation described in FIG. 4. The element out detection circuits 160 and 162 include optoisolators 164-1 and 164-2, referred to collectively as optoisolators 164, current limiting resistors or capacitors 166-1 and 166-2, referred to collectively as capacitors 166, and reverse bias relief diodes 168-1 and 168-2, referred to collectively as diodes 168. Resistors 170-1 and 170-2 condition outputs 172-1 and 172-2 of the optoisolators 168 for the control module 72.

When relays 172 and 174 are closed, relays 176 and 178 are open, and heating elements 180-1 and 180-2 are functioning properly, current flows between a first voltage source 182 and earth ground 184, through the heating elements 180. The optoisolators 164 are ON, and the control module 72 receives one or more detection signals 186-1 and 186-2 indicative of the current flowing through the element out detection circuits 160 and 162. If one or more of the heating elements 180 is out, current through one of the optoisolators 164 is interrupted. The corresponding signal 186 then indicates that a heating element is out. For example, the detection signal 186-1 indicates when the heating element 180-1 is out, and the detection signal 186-2 indicates when the heating element 180-2 is out.

The element out detection circuits 160 and 162 may also be used to detect a condition of one or more of the relays. For example, regardless of whether the heating element 180-2 is functioning properly, current will flow through the optoisolator 164-2 when the relays 172 and 178 are closed. In other words, when the relays 172 and 178 are closed, current will flow between a second voltage source 188 and the earth ground 184. However, if one or more of the relays 172 and 178 are supposed to be open (i.e. the control module 72 is attempting to open the relay 178), the detection signal 186-2 indicates the actual state of the relay. For example, if the relay 178 fuses closed, the control module 72 is no longer able to open the relay 178. The detection signal 186-2 indicates that the relay 178 is closed notwithstanding the control of the control module 72.

Figure 8A:
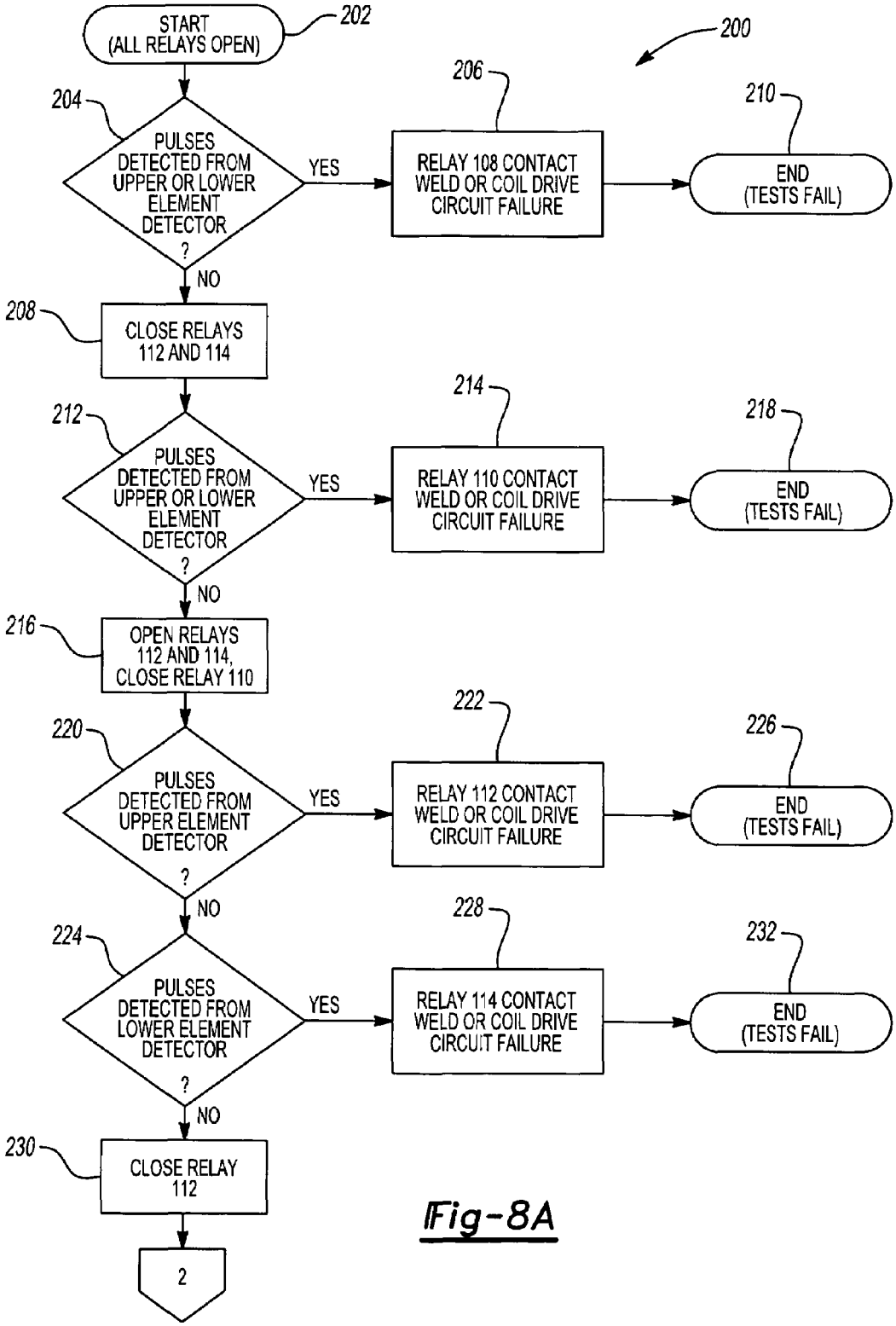
FIG. 8 illustrates an element out detection algorithm according to the invention.
Figure 8B:
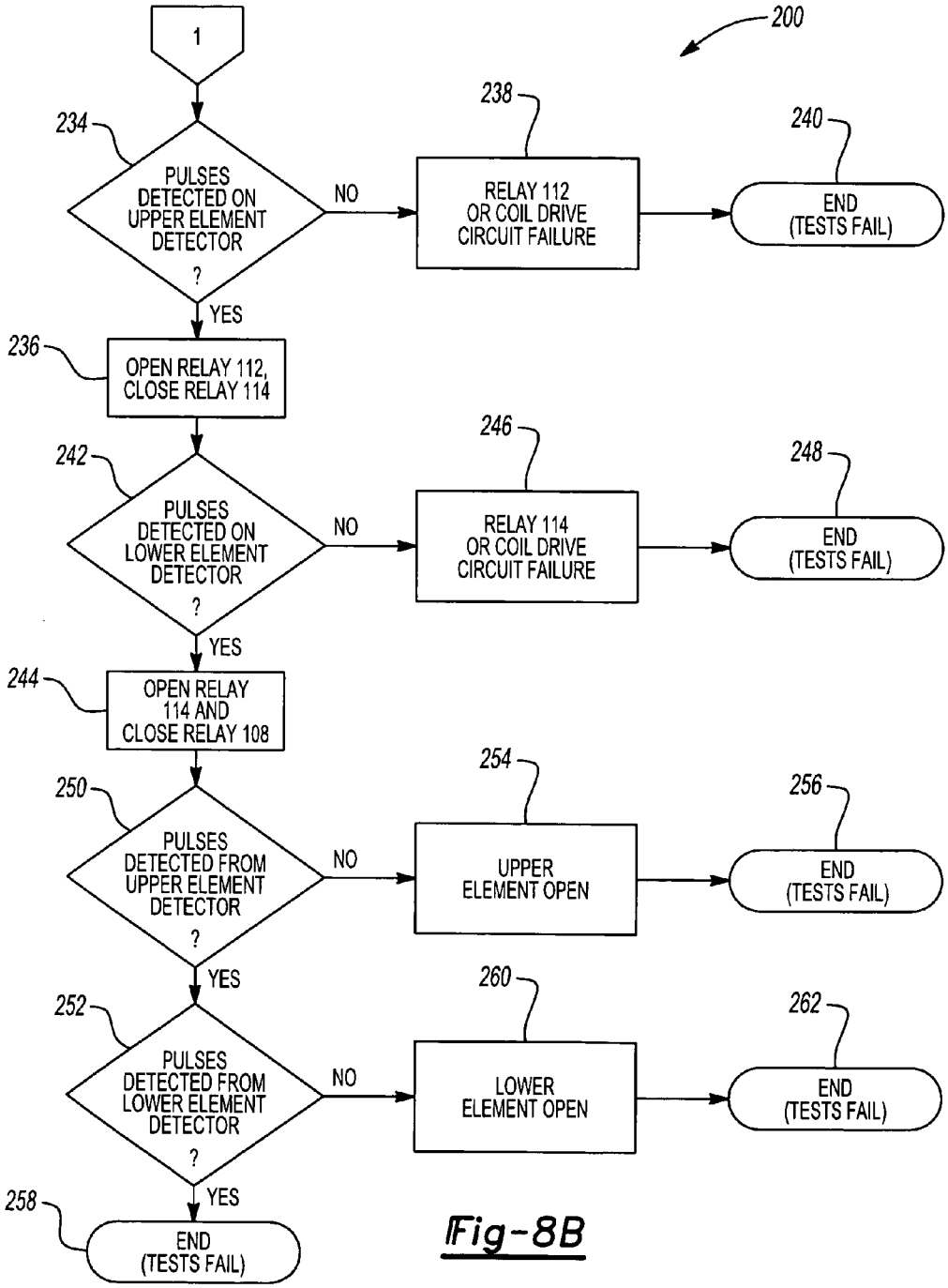

The control module implements an element out detection method 200 as shown in FIG. 8 (and in reference to FIG. 4). In step 202, the method 200 starts with all relays open. In step 204, the method 200 determines whether pulses are detected from one or more of the detector modules (i.e. current is flowing through one or more of the detector modules). If true, the method 200 continues to step 206. If false, the method 200 continues to step 208. In step 206, the method 200 determines that the relay 108 is closed due to a malfunction. For example, the relay 108 may be fused closed. Additionally, the coil drive circuit of the relay may be malfunctioning. In other words, although all relays should be open, current is flowing from the second voltage source 88, through the relay 108, to the element out detection modules 102 and 104. In step 210, the method 200 terminates. For example, because the relay 108 is closed due to a malfunction, the method 200 aborts power-up of the electric water heater control.

In step 208, the method 200 closes the relays 112 and 114. In step 212, the method 200 determines whether pulses are detected from one or more of the detector modules. If true, the method 200 continues to step 214. If false, the method continues to step 216. In step 214, the method 200 determines that the relay 110 is closed due to a malfunction. The method 200 terminates in step 218.

In step 216, the method 200 opens the relays 112 and 114, and closes the relay 110. In step 220, the method 200 determines whether pulses are detected from the detector module 74-1. If true, the method 200 continues to step 222. If false, the method 200 continues to step 224. In step 222, the method 200 determines that the relay 112 is closed due to a malfunction. The method 200 terminates in step 226.

In step 224, the method 200 determines whether pulses are detected from the detector module 74-2. If true, the method 200 continues to step 228. If false, the method 200 continues to step 230. In step 228, the method determines that the relay 114 is closed due to a malfunction. The method 200 terminates in step 232.

In step 230, the method 200 closes the relay 112. In step 234, the method 200 determines whether pulses are detected from the detector module 74-1. If true, the method 200 continues to step 236. If false, the method 200 continues to step 238. In step 238, the method 200 determines that the relay 112 is open due to a malfunction. The method 200 terminates in step 240.

In step 236, the method 200 opens the relay 112 and closes the relay 114. In step 242, the method 200 determines whether pulses are detected from the detector module 74-2. If true, the method 200 continues to step 244. If false, the method 200 continues to step 246. In step 246, the method 200 determines that the relay 114 is open due to a malfunction. The method 200 terminates in step 248.

In step 244, the method 200 opens the relay 114 and closes the relay 108. In step 250, the method 200 determines whether pulses are detected from the detector module 74-1. If true, the method 200 continues to step 252. If false, the method 200 continues to step 254. In step 254, the method 200 determines that the upper heating element 116 is open (e.g. burned out). The method 200 terminates in step 256. In step 252, the method 200 determines whether pulses are detected from the detector module 74-2. If true, the method 200 continues to step 258. If false, the method 200 continues to step 260. In step 260, the method 200 determines that the lower heating element 118 is open. The method 200 terminates in step 262. In step 258, the method 200 determines that all relays and heating elements are functioning properly and then terminates.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A control for an electric water heater, the electric water heater including at least one heating element, the control comprising:

a switching module that has an open state and a closed state and is connected between a first voltage potential and the heating element; and a detector module connected in parallel to the switching module that senses current flowing through the heating element when the switching module is in the open state, and that generates a detection signal that is indicative of the current.

2. The control of claim 1 further comprising a control module that receives the detection signal.

3. The control of claim 1 wherein the control module is operable to transition the switching module between the open state and the closed state.

4. The control of claim 1 wherein the detector module includes a current limiting module.

5. The control of claim 4 wherein the current limiting module is one of a resistor or a capacitor.

6. The control of claim 4 wherein the current limiting module limits current flow through the heating element.

7. The control of claim 1 wherein the detector module includes an optoisolator circuit that has a conducting state and a non-conducting state, and that is in the conducting state when current is flowing through the heating element and is in the non-conducting state when the current is not flowing through the heating element.

8. A control for an electric water heater, the electric water heater including at least one heating element, the control comprising:

a switching module that has an open state and a closed state and is connected between a first voltage potential and the heating element; and a detector module connected in parallel to the switching module that senses current flowing through the heating element when the switching module is in the open state, and that generates a detection signal that is indicative of the current, wherein the detector module includes an optoisolator circuit that has a conducting state and a non-conducting state, and that is in the conducting state when current is flowing through the heating element and is in the non-conducting state when the current is not flowing through the heating element, and wherein the detector module includes an output conditioning module that communicates with the optoisolator circuit, and that generates the detection signal.

9. The control of claim 8 wherein the detection signal is a first state if the optoisolator circuit is in the conducting state and is in a second state if the optoisolator circuit is in the non-conducting state.

10. A control for an electric water heater, the electric water heater including at least one heating element, the control comprising:

a switching module that has an open state and a closed state and that is connected between a first voltage potential and the heating element;

an optoisolator circuit that senses current flowing through the heating element when the switching module is in the open state; and an output conditioning module that generates a detection signal that is indicative of the current.

11. The control of claim 10 further comprising a control module that receives the detection signal.

12. The control of claim 10 wherein the control module transitions the switching module between the open state and the closed state.

13. The control of claim 10 wherein the detector module includes a current limiting module.

14. The control of claim 13 wherein the current limiting module includes at least one of a resistor and a capacitor.

15. The control of claim 13 wherein the current limiting module limits current flow through the heating element.

16. The control of claim 10 wherein the optoisolator circuit has a conducting state and a non-conducting state, and wherein the optoisolator circuit is in the conducting state when current is flowing through the heating element and is in the non-conducting state when the current is not flowing through the heating element.

* * * * *

UNITED STATES PATENT AND TRADEMARK OFFICE

CERTIFICATE OF CORRECTION

PATENT NO. : 7,668,445 B2
APPLICATION NO. : 11/495067
DATED : February 23, 2010
INVENTOR(S) : Miller et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 642 days.

Signed and Sealed this

Twenty-eighth Day of December, 2010

David J. Kappos

David J. Kappos
*Director of the United States Patent and Trademark Office*